United States Patent [19]

Nishimoto et al.

[11] Patent Number: 4,760,765

[45] Date of Patent: Aug. 2, 1988

[54] MOVABLE STACKER FOR A FOOD LOAF SLICING MACHINE

[75] Inventors: Yoshitaka Nishimoto; Kanji Tamaki, both of Wakayama, Japan

[73] Assignee: Ryowa Reiki Seisakusho, Ltd., Japan

[21] Appl. No.: 106,867

[22] Filed: Oct. 13, 1987

[30] Foreign Application Priority Data

Mar. 20, 1987 [JP] Japan ..... 62-67441

[51] Int. Cl.[4] ..... B26D 7/32

[52] U.S. Cl. ..... 83/92; 83/29; 414/45; 271/217

[58] Field of Search ..... 83/29, 92, 91; 271/217; 414/45; 83/94, 77

[56] References Cited

U.S. PATENT DOCUMENTS 3,161,215 12/1964 Werder et al. ..... 83/92 X
3,824,885 7/1974 Marshall et al. ..... 83/19
4,405,186 9/1983 Sandberg et al. ..... 414/21

*Primary Examiner*—Donald R. Schran

[57] ABSTRACT

The invention concerns a stacker for a food loaf slicing machine of the type which includes first and second stack supports capable of being alternately positioned so as to receive food loaf slices of generally uniform thickness thereon as they are cyclically cut from the end of a food loaf at a slicing station into which the food loaf is advanced. When one of the stack supports has received a stack of N slices thereon, it is momentarily rotated a half turn outwardly of its slice receiving position under a force which exceeds a frictional force exerted between the underside of the stack and the upper surface of the stack support. As the one stack support is so rotated, the stack of slices present thereon is, virtually without being subject to any lateral force, allowed to fall freely downward as it is, until it is placed on a conveyor. Thereupon, the other stack support, which has been held on standby outside of and at same level as an initial slice receiving position, is momentarily rotated a half turn and thus brought to the initial slice receiving position before a first slice of a next slicing cycle falls down to the slice receiving position. Each time this other stack support receives a slice, it is cyclically lowered a distance corresponding to each additional slice. While the other stack support is in the process of being displaced downward, the one stack support is elevated to the level of the initial slice receiving position.

5 Claims, 8 Drawing Sheets

MOVABLE STACKER FOR A FOOD LOAF SLICING MACHINE

BACKGROUND OF THE INVENTION

1. Industrial Fieald of the Invention

The present invention relates to a stacker for stacking food loaf slices for use in a food slicing machine.

2. Prior Art

Recently it has become not unusual that food loaf products, such as, for example, ham loaf products, are vacuum packaged in sliced condition and sold in the form of a packaged product at food stores, food floors of super markets, and the like retail outlets.

Such packaged form of sliced ham products is broadly classified into two, namely, one in which a given number of ham slices (N slices), each of a predetermined thickness, are packaged in stacked condition as such, and the other in which N slices of ham are packaged in overlapping fashion, one over another.

These two types of packaged ham products are commercially produced as such by slicing ham loaves by a ham slicing machine in a ham producer's germ-free room, then packing ham slices so produced into packages by a packaging machine. In the ham producer's factory, it is required that a large number of ham loaves be sliced as efficiently as possible and that these ham loaf slices be packed into packaged products in sanitary manner and with the least possible chance of human hand touching the ham slices.

To this end, a number of movable stackers for use in food loaf slicing machines for slicing an elongate food loaf, such as ham loaf, into slices of a predetermined thickness have been developed which are of the type that a predetermined number of food loaf slices are received on the stacker as they are dropped from a slicing station, with no chance of the slices being touched by hand, so that a stack of slices is formed on the stacker, the stack being then moved to a position at which it has no chance to interfere with a next cycle of receiving slices as they drop on the stacker. For example, disclosures relating to such stacker are found in U.S. Pat. No. 4,405,186 and U.S. Pat. No. 3,824,885.

Now, a ham loaf, in its form prior to being sliced, generally has a circular or quadrangular sectional configuration of 600–1600 mm in length and 90–100 mm in diameter. Normally, in known ham slicing machines, a ham loaf of such configuration, set upright or in a slightly inclined condition, is fed downwardly at a constant speed while being held between a pair of conveyors arranged in opposed relation in the longitudinal direction of the ham loaf, and the ham loaf delivered into the slicing station of the ham slicing machine is cut by a cutter rotating at a constant speed into slices of a predetermined thickness from its lower end.

Therefore, if ham loaf slices as cut by such a ham slicing machine are to be stacked on a stack support (such as, for example, receiver plate, receiver comb, or conveyor) without any horizontal irregularity, that is, if ham loaf slices are to be stacked upright on the stack support while exhibiting virtually same appearance as the original ham loaf, it is essential that the distance between the front end of the cutter and the position at which the falling movement of each ham slice ends should be always constant.

In the above cited prior-art arrangements, therefore, stack supports are movable upward and downward so that each time a food loaf slice drops on one of the stack supports, the stack support is lowered a distance corresponding to the thickness of one slice, whereby the distance of slice dropping is always kept constant.

With such stack support arrangement, however, it is necessary that when a stack of N slices is formed on the stack support in such way as above mentioned, the stack must be transported to a location outside the slice dropping position so as for it not to interfere with a next cycle of stack forming. Further, if the ham slicing machine is continuously operated in order to maintain a constant slice thickness, and if the machine is run at high speed in order to obtain increased efficiency, each stack of slices, as it is formed, must be promptly moved away from the slice dropping position while the cutter is in the course of one rotation, that is, within one slice cycle of the cutter.

To this end, the stackers disclosed in aforesaid U.S. Pat. No. 3,824,885 and U.S. Pat. No. 4,405,186 are of such arrangement that when a stack of slices is formed on one stack support, the stack support is rapidly moved downward and another stack support is brought to an initial slice receiving position.

SUMMARY OF THE INVENTION

Problems Sought to be Solved by the Invention

However, the movable stacker disclosed in U.S. Pat. No. 3,824,885 is such that a pair of stack supports arranged in a windmill pattern rotate generously about a horizontal shaft so that one stack support alternates with the other in such a manner that the one stack support rotates downwardly from a top position to move into an initial slice reciving position below the slicing station. Apparently, such movable stacker requires a very large space for rotation of the stack supports. Another problem with the stacker is that the distance between the cutter and the slice receiving position (i.e., the distance of slice free fall) is excessively large.

The movable stacker disclosed in U.S. Pat. No. 4,405,186 comprises two pairs of stack supports, and therefore it is complicated in construction. Further, in this movable stacker, means provided for moving a stack of slices formed on one stack support to a location outside the slice dropping position are of such a design that the stack support on which the stack is present is first rapidly moved downwardly to a stack discharge position, whereby another stack support can be moved into an initial slice receiving position. Such means for lowering stack supports naturally add so much to the problem of structural complicatedness of the stacker.

In view of these problems with the prior-art stacker arrangements, the present invention proposes a movable stacker of a simplified construction in which the number of stack supports is limited to one pair instead of two pairs in the movable stacker disclosed in U.S. Pat. No. 4,405,186, and in which the mechanism for rapidly lowering a stack support on which a stack of slices is present toward a discharge position and drive means for said rapid lowering, both required in said prior-art movable stacker, are eliminated.

Means for Solving the Problems

In order to accomplish the aforesaid task, the present invention provides a movable stacker for a food loaf slicing machine of the following arrangement, namely: in a food loaf slicing machine including a slicing station into which a food loaf is advanced generally downwardly and in which slices of generally uniform thickness are cyclically sliced from the lower end of the loaf, the slices being allowed to drop down as they are cut, conveyor means disposed below the slicing station and in spaced apart relation therewith for receiving the slices thereon and transporting them outward from the position at which they are received, and a stacker disposed between the slicing station and the conveyor means for receiving the slices on its stack supports at a position right under the slicing station, as they are dropped from above, so as to form stacks of N slices thereon and for discharging each stack, as it is formed, onto the conveyer means at a position substantially right below the stacker, said stacker comprising:

1. a pair of rotary shafts disposed at both sides of said conveyor means, one on each side, said rotary shafts being rotatable and up and down movable and having, at their respective upper ends, stack supports mouned thereon, one on each shaft;

2. each of said stack supports being movable along a predetermined closed-loop path downwardly from an intial slice receiving position right below the slicing station at which the stack support receives a first food loaf slice as the slice drops substantially freely from the slicing station, through a range of N−1 additional slice receiving positions each displaced approximately one additional slice thickness downwardly from said initial slice receiving position, rotatably outwardly from the final one of the additional slice receiving positions, then upwardly to same level as the initial slice receiving position, and rotatably to the initial slice receiving position;

3. stack support drive means connected to said pair of rotary shafts for moving said pair of stack supports along the closed-loop path in 2N slicing cycles, said drive means comprising elevation drive means for elevating one of the stack supports from the level of the final slice receiving position and to the level of the initial slice receiving position, while the other stack support is in downward movement from the initial slice receiving position and to the final slice receiving position, outside said slice receiving positions and at a velocity faster than the velocity of downward movement of said other stack support, and rotation drive means for rotating one of the stack supports outwardly of the final slice receiving position after said one stack support has reached said final slice receiving position and, simultaneously therewith, rotating the other stack support at its most elevated position and toward the initial slice receiving position; and 4. the upper surface of said stack supports each having a coefficient of friction to the cut surface of each food loaf slice which is smaller than that between the cut surfaces of food loaf slices so as to enable a stack of slices on the stack support to relatively slip on the stack support at the most lowered position thereof, when the stack support is rotated, so that the stack of slices is freely dropped generally downwardly, said stack support rotation drive means being able to rapidly rotate the stack support momentarily by a force which exceeds the frictional force exerted between the underside of the stack of slices on the stack support and the upper surface of the stack support.

Function

The characteristic features of the movable stacker in accordance with the invention are as indicated above. Therefore, a food loaf fed downwardly into the slicing station is cyclically sliced into slices of generally uniform thickness from the lower end thereof at the slicing station, and the slices are handled according to the following sequence and thus a stack of N slices is formed. That is:

i. First, one stack support is positioned at an initial slice receiving position immediately below the slicing station. That is, the stack support is rotated inwardly from a most elevated position outside the initial slice receiving position until it is positioned at said initial slice receiving position at which the stack support receives a first food loaf slice thereon by interrupting the free fall of the slice as it drops from the slicing station. Meanwhile, the other stack support is rotated outwardly from a most lowerd one of the slice receiving positions (a final slice receiving position) until it is brought to a location outside the slice receiving position above aforesaid conveyor means.

ii. Then, said one stack support is moved downward by a distance corresponding to the thickness of one slice during one slicing cycle in which the cutter rotates one turn. That is, as the stack support receives a first food loaf slice as the slice falls down from the slicing station, it is lowered to a next slice receiving position, one slice thickness lower, and such downward movement is cyclically continued through a range of N−1 additional slice receiving positions. Therefore, each additional food loaf slice is always received and stacked on the top surface of a stack of slices present right below the slicing station as it is sliced at and drops a given distance from the station, until a stack of N slices is formed on the stack support.

iii. While the one stack support is being lowered in manner as described in item ii above, the other stack support is elevated, outside the series of slice receiving positions, to the level of the intial slice receiving position at a velocity faster than the rate of downward movement of said one stack support. Therefore, said other stack support reaches the most elevated position in the meantime and is held there in a standby position.

iv. Therefore, when said one stack support has reached the final slice receiving position or N−1 lowered position and received Nth slice, the rotation drive means are actuated to rotate the pair of stack supports so that the one stack support is displaced outward from the slice receiving position while the other stack support is displaced to the first slice receiving position. The one stack support is rapidly rotated momentarily under a force which exceeds the frictional force exerted between the underside of the stack of slices present on the stack support and the upper surface of the stack support, and accordingly the stack of N slices on the stack support is caused to slip relatively due to its inertia and fall generally downwardly as it stands. Thus, the stack mounts on the conveyor. The other stack support is brought to the initial slice receiving position at a momentary speed for a next cycle of slice stacking, before a first slice of the next cycle drops onto the receiving position.

v. In a slicing cycle for next N slices, the other stack support alternates the one stack support and thus a pair of stack supports operate in same manner as described in items i–iv above.

vi. For each subsequent N slicing cycle, the stack supports alternately receive food loaf slices thereon to form a stack of slices thereon, the stack being then discharged onto the conveyor.

DESCRIPTION OF THE PREFERRED EMBODIMENT

One embodiment in which the movable stacker in accordance with the invention is applied to a ham loaf slicing machine will now be described with reference to the accompanying drawings.

Ham Loaf Delivery Mechanism and Cuuter Device

Figure 1:
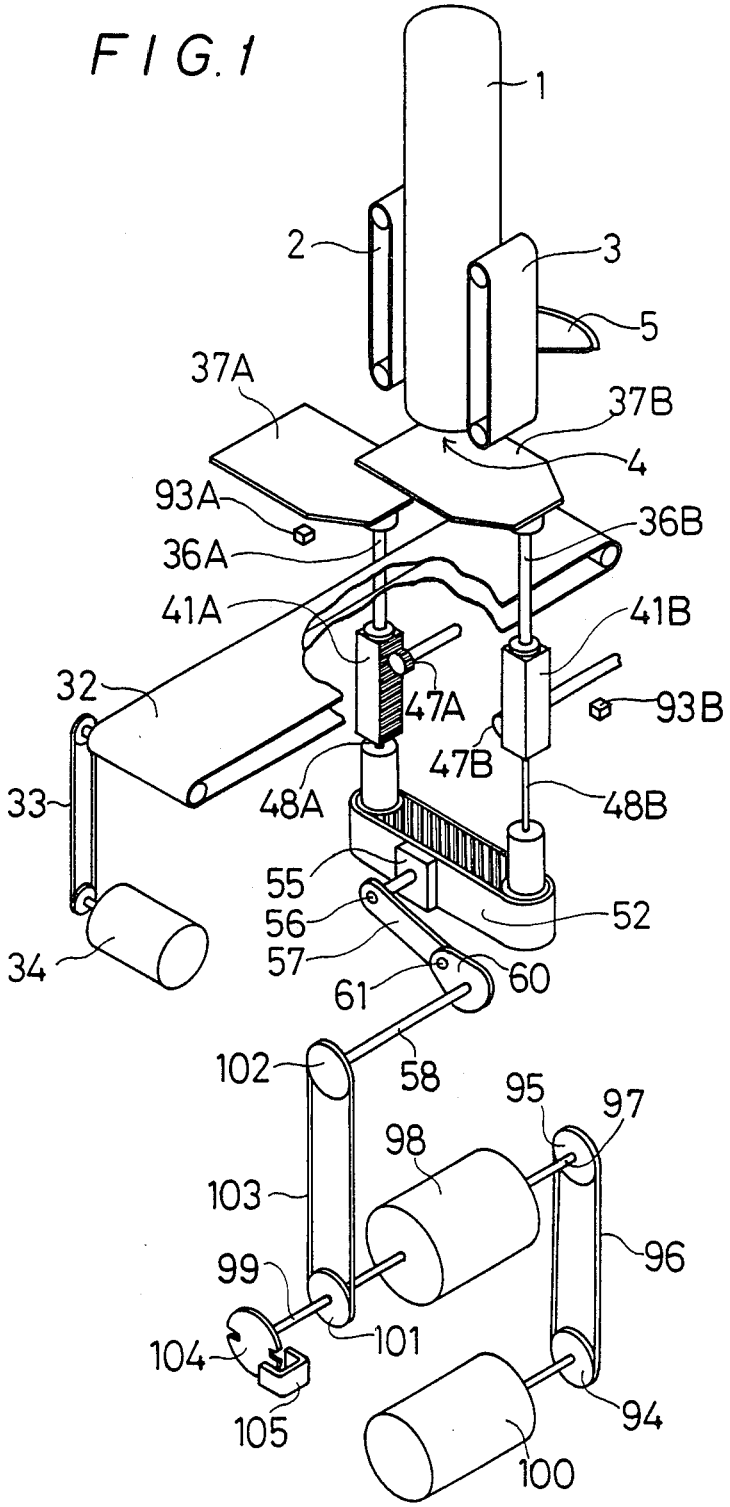
FIG. 1 is a perspective view showing a schematic arrangement of a movable stacker in a ham loaf slicing machine according to the invention, with rotation drive means for stack supports.
Figure 2:
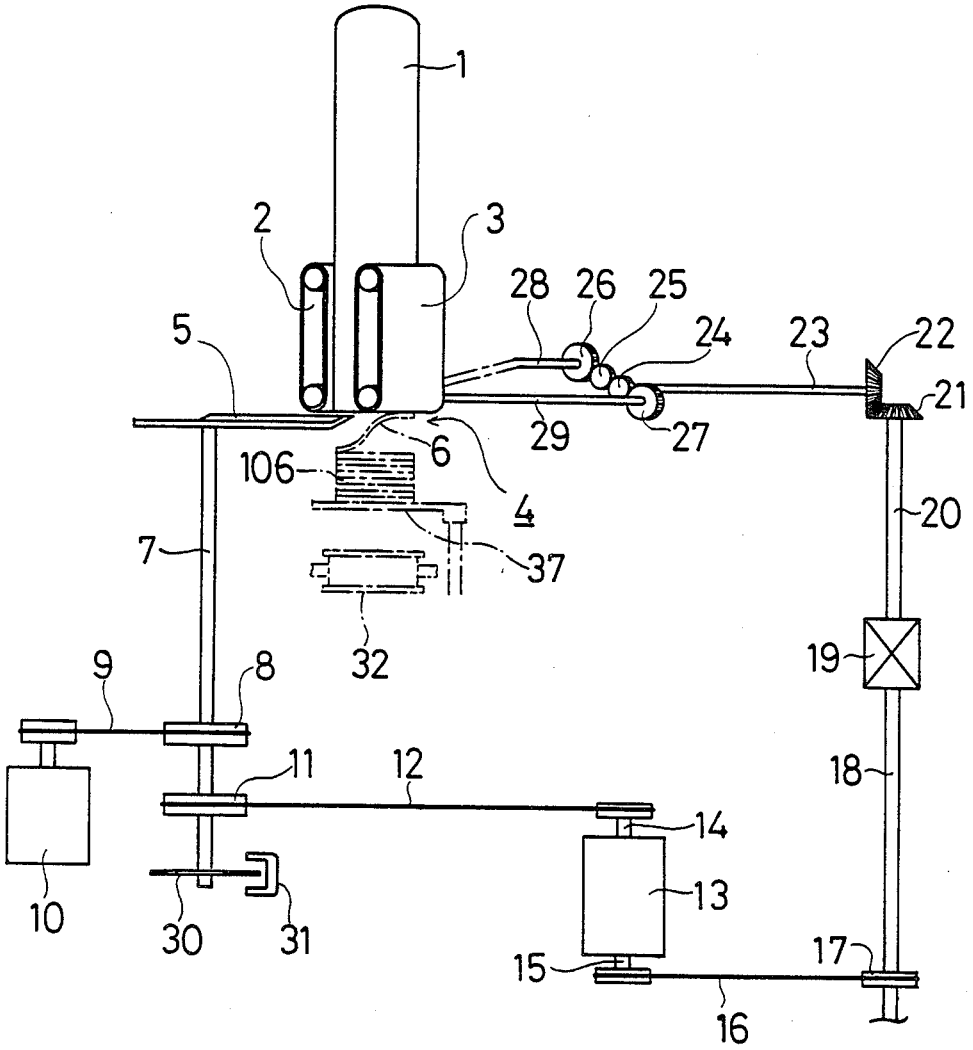
FIG. 2 is a schematic view showing drive means for the ham loaf slicing machine.

A ham loaf delivery mechanism and a cutter device in the ham loaf slicing machine of the present embodiment are generally same as those in known ham loaf slicing machines, as FIGS. 1 and 2 show. The ham loaf delivery mechanism consists of a pair of loaf deliver conveyors 2, 3 vertically arranged in opposed relation so as to hold between them a ham loaf 1 set upright. The loaf delivery conveyors 2, 3 are so designed that when their opposed surfaces are driven downwardly, the ham loaf 1 is advanced into a slicing station 4 at a predetermined speed. A rotary cutter 5 is disposed in the slicing station 4. The ham loaf 1, as it is advanced into the slicing station 4, is cyclically sliced by the rotary cutter 5 into slices 6 of generally uniform thickness from the lower end thereof. Ham loaf slices 6 are allowed to drop downward as they are sliced.

The rotary cutter 5 is mounted to the upper end of a cutter shaft 7 which is connected through a pulley 8 and a belt 9 to a motor 10 or a drive source for the slicing machine. The cutter shaft 7 is connected to an input shaft 14 of a speed change gear 13 through a pulley 11 and a belt 12. An output shaft 15 of the change gear 13 is connected to a shaft 18 through a belt 16 and pulley 17 so that the rotation of the shaft 18 is transmitted to drive shafts 28, 29 of said pair of loaf delivery conveyors 2, 3 through a clutch brake 19, a shaft 20, bevel gears 21, 22, a shaft 23, and interlocking gears 24, 25, 26, 27. Therefore, if the clutch brake 19 is closed, the pair of loaf delivery conveyors 2, 3 are driven in conjunction with the cutter 5 by the motor 10, which is a common drive source for the cutter 5 and the conveyors 2, 3.

The rotation speed and rotational position of the cutter shaft 7 are measured by means of an optical sensor 31 disposed opposite to a plate 30 mounted to one end of the shaft 7, as the sensor 31 detects the rotation of the plate 30.

Below the slicing station 4 and in spaced relation therewith, there is provided a belt conveyor 32 for receiving thereon a stack of slices formed by the stacker of the invention (to be described hereinafter) and transporting same to a location outside a position of slice dropping from the slicing station 4. The conveyor belt 32 is driven by a drive source 34, one separate from aforesaid motor 10, through a belt 33.

Construction of Movable Stacker

The movable stacker in accordance with the invention comprises a pair of rotary shafts 36A, 36B rotatably and up and down movably disposed at both sides of aforesaid belt conveyor 32 and supported by a machine frame 35, and stack supports 37A, 37B mounted respectively on the rotary shafts 36A, 36B at their respective upper ends. The rotary shafts 36A, 36B each, as can be seen from FIG. 3 in which the rotary shaft 36A is illustrated in detail, comprises a hollow shaft 40 having at its upper end a solid shaft 38 fitted therein for stack support mounting and at its lower end a spline boss 39 fitted therein. The rotary shafts 36A, 36B have at their lower end portion racks 41A, 41B fitted thereon which are respectively parallel to and rotatable relative to the shafts 36A, 36B.The racks 41A, 41B are respectively held unslidable relative to the rotary shafts 36A, 36B by retaining rings 42, 43 fitted respectively over the shafts 36A, 36B and in contact with the upper and lower ends of the racks 41A, 41B. Further, the racks 41A, 41B are locked against rotation relative to the machine frame 35 by whirl stop pieces 45 fastened by screws 44, 44 to the sides of the racks 41A, 41B and which are slidably fitted in vertically elongate holes 46 bored in front portions of the machine frame 35. Thus, when pinions 47A, 47B held in engagement respectively with the racks 41A, 41B are rotated, the rotary shafts 36A, 36B are moved upward and downward. A drive mechanism for the pinions 47A, 47B will be described hereinafter.

Figure 6:
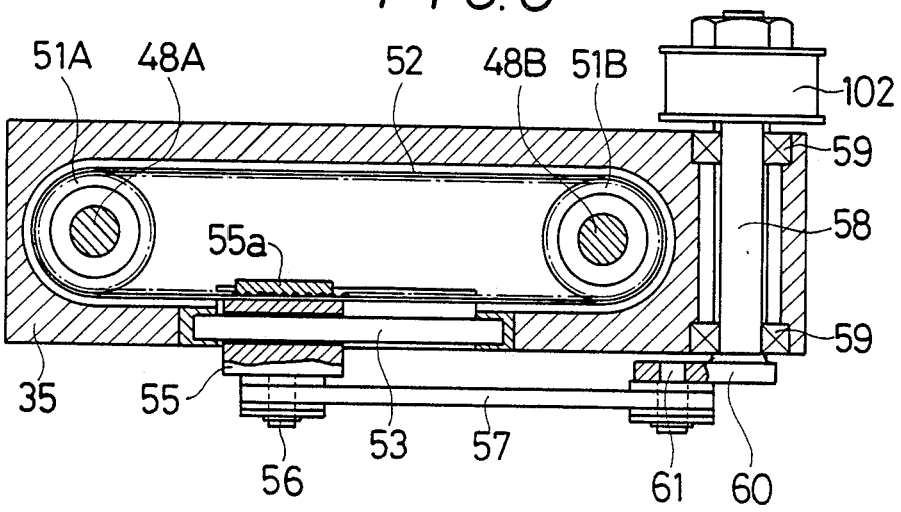
FIG. 6 is a section taken along line VI—VI in FIG. 3.

A pair of spline shafts 48A, 48B are respectively fitted in the corresponding lower ends of the rotary shafts 36A, 36B through aforesaid spline bosses 39 in which said spline shafts 48A, 48B are fitted, the respective lower ends of the spline shafts 48A, 48B being rotatably supported at 50 by the machine frame 35. Timing pulleys 51A, 51B are respectively fitted on the lower end portions of the spline shafts 48A, 48B which are rotatably supported in a pair of bearings 50, 50, and an endless timing belt 52 is entrained between the timing pulleys 51A, 51B. On the machine frame 35 and along a straight run portion of the timing belt 52 there are mounted two guide bars 53, 53 parallel to the timing belt 52 and fixed at their both ends to the frame 35. A slide block 55 slidably guided by the two guide bars 53, 53 in horizontal directions (rightward and leftward in FIGS. 3, 6) is connected to the timing belt 52 through a clamp 55*a*. The slide block 55 is connected through a pin 56 and a crank rod 57 to a crank pin 61 of a crank 60 whose shaft 58 is rotatably supported at 59, 59 in the machine frame 35.

By the above described arrangement, if the crank shaft 58 is rotated one turn, the pair of rotary shafts 36A, 36B is rotated one double stroke over a rotation angle of 180 through the crank rod 57, the timing belt 52, and the pair of spline shafts 48A, 48B. A drive mechanism for the crank shaft 58 will be described hereinafter.

Figure 3:
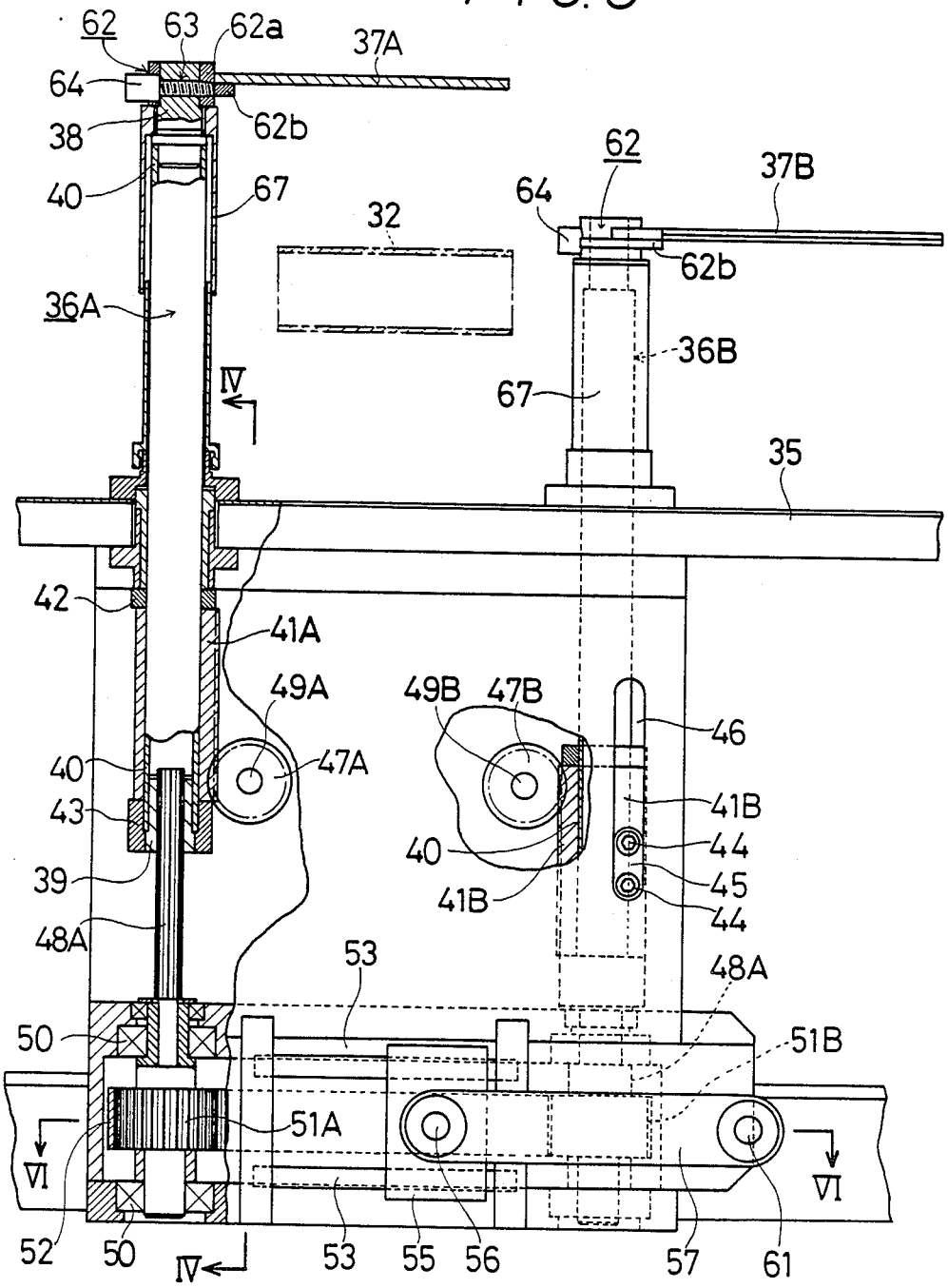
FIG. 3 is a partly longitudinal sectional front view showing key portion of the movable stacker (the longitudinal sectional plane being taken along line III—III in FIG. 4)
Figure 7:
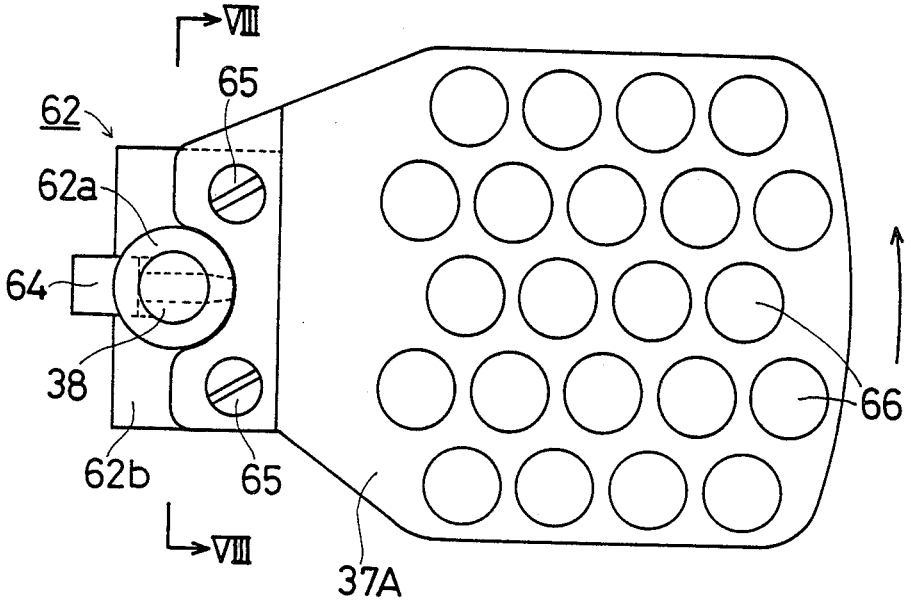
FIG. 7 is a plane view showing a stack support.
Figure 8:
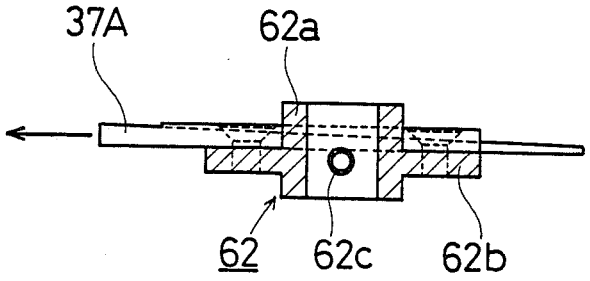
FIG. 8 is a side view thereof.

On the pair of rotary shafts 36A, 36B at their upper ends, as FIG. 3 shows, there are respectively mounted a pair of stack supports 37A, 37B at one end, both facing same direction. That is, one stack support 37A is disposed at slice receiving position above the belt conveyor 32 and the other stack support 37B is disposed outside the slice receiving position, the two being mounted respectively to the rotary shafts 36A, 36B through removable brackets 62, 62. The brackets 62 (see FIGS. 3, 7, 8) are respectively set in position to the rotary shafts 36A, 36B by means of corresponding set screws 64 which are each screwed into a laterally extending threaded hole 63 bored in one of the solid shafts 38 and through a laterally extending hole 62*c* bored in a ring shaped base portion 62*a* of the relevant bracket 62 which fits on the relevant one of the rotary shafts 36A, 36B. The stack supports 37A, 37B, each consisting of a plate like member, are fixed at one end by screws 65 respectively to horizontal platelike mounts 62*b* of the brackets 62. Therefore, the stack supports 37A, 37B in this embodiment are each removable between the rotary shaft 36A or 36B and the corresponding bracket 62 and between one of the brackets 62 and the stack support 37A or 38A.

The stack supports 37A, 37B each is formed on its surface with a multiplicity of lightening holes 66 which are chamfered at edge portions, for the purpose of weight reduction. Further, in order to reduce the possible frictional force between the stack support 37A, 37B and a ham slice, the stack support 37A, 37B has a slightly sloped upper surface such that when it rotates outwardly from the slice receiving position above the belt conveyor 32, the upper surface of the stack support 37A, 37B is slightly backwardly slanted (2°–3° relative to the plane of rotation) in the direction of its rotation (the direction of the arrow in FIGS. 7 and 8).

It is noted that, as FIG. 3 shows, that portion of each rotary shaft 36A, 36B which extends upward from the machine frame 35 is covered with a telescopic cover 67.

The movable stacker in accordance with the invention is of such arrangement as above described. Therefore, the pair of stack supports 37A, 37B can be individually elevated and lowered by individually driving the pair of pinions 47A, 47B, and the pair of stack supports 37A, 37B can be alternately moved to and outwardly from the slice receiving position between the slicing station 4 and the belt conveyor 32 by driving the crank shaft 58.

Figure 9:
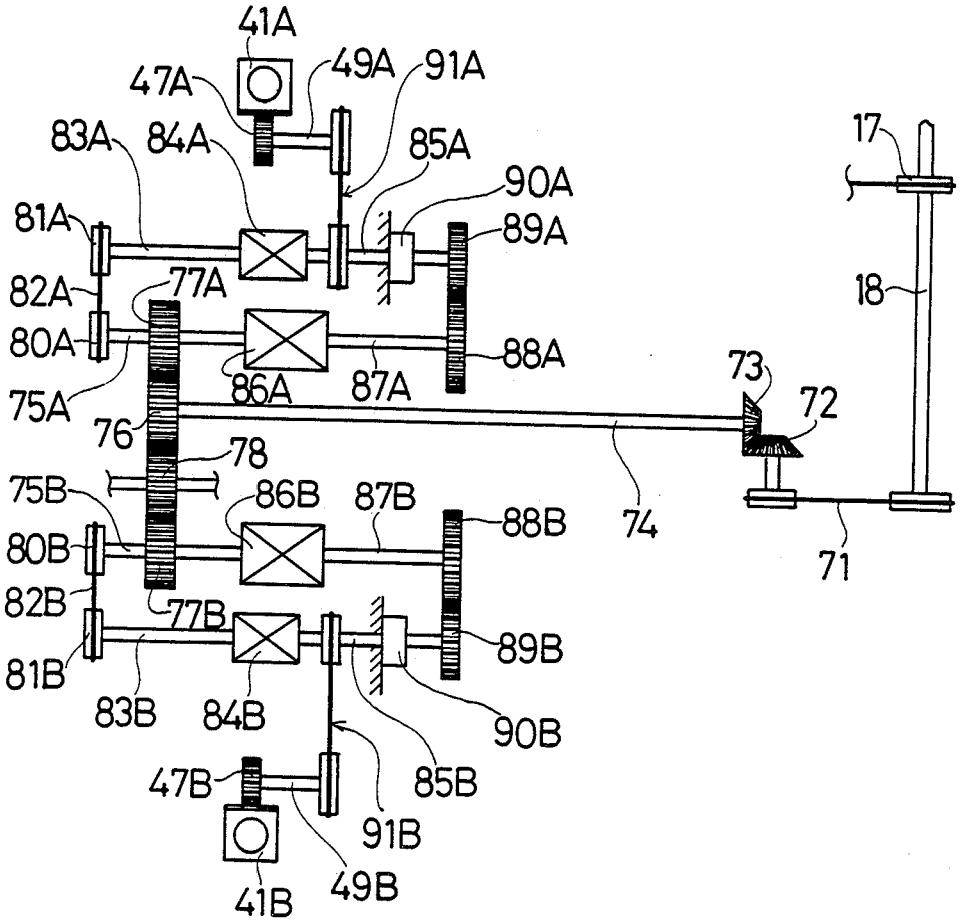
FIG. 9 is a schematic view showing elevation drive means for the stacker.

In this conjunction, drive means for the pair of pinions 47A, 47B, that is, elevation drive means for individually elevating and lowering the pair of rotary shafts 36A, 36B, will be nextly described with reference to FIG. 9, and then drive means for the shaft 58 of the crank 60, that is, rotation drive means for simultaneously rotating the pair of rotary shafts 36A, 36B 180° will be explained with reference to FIG. 1.

Elevation Drive Means for Stack Supports

The elevation drive means for the pair of rotary shafts 36A, 36B are of the following arrangement. Shafts 49A, 49B of the pair of pinions 47A, 47B shown in FIG. 9 are connected through the following interlocking mechanism to aforesaid rotary shaft 18 which is interlockingly connected to the drive motor 10 for the cutter 5, so that they are driven in conjunction with the cutter 5 and the ham loaf feed conveyors 2, 3. That is, the rotary shaft 18 is connected to a shaft 74 though a belt 71 and bevel gears 72, 73. In the present embodiment, the racks 41A, 41B are disposed in opposed relation; therefore, the rotation of the shaft 74 is transmitted through gears 76, 77A to a shaft 75A, one of a pair of input shafts 75A, 75B disposed parallel to the shaft 74 for driving said pair of pinions, and through gears 76, 78, 77B to the other input shaft 75B, so that rotations transmitted to the input shafts 75A, 75B are directionally opposite to each other. Thus, the one rack 41A is elevated when the pinion 47A is driven forward, while the other rack 41B is elevated when the pinion 47B is driven reverse. These input shafts 75A, 75B for pinion driving are respectively able to move the racks 41A and 41B upward and downward through interlocking mechanisms of same construction.

Now, referring first to the drive system for said one pinion 47A which is driven by a drive force supplied to the one pinion driving input shaft 75A, the input shaft 75A is connected at one end to an intermediate shaft 83A parallel thereto through a pair of pulleys 80A, 81A and a belt 82A, said intermediate shaft 83A being connected through a clutch 84A to an output shaft 85A for driving the pinion 47A. The input shaft 75A is connected at the other end thereof to another intermediate shaft 87A through a clutch 86A, said intermediate shaft 87A being acceleratedly connected to the output shaft 85A for driving the pinion 47A through a pair of different size gears 88A, 89A. It is noted that said clutches 84A and 86A are so designed that they are not brought in simultaneous engagement. Shown by 90A is a brake for the output shaft 85A for driving the pinion 47A. Said output shaft 85A is connected to the shaft 49A of the pinion 47A through an interlocking system 91A.

Figure 4:
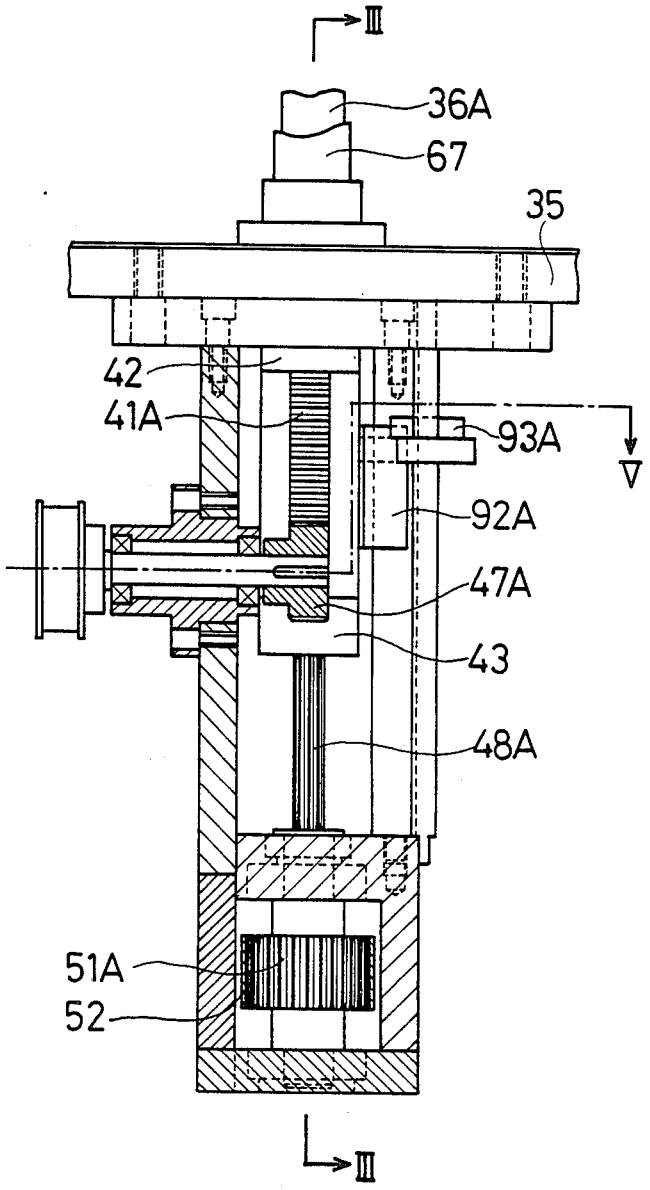
FIG. 4 is a partly longitudinal sectional side view thereof (the longitudinal sectional plane being taken along line IV—IV in FIG. 3)

A plate 92A for detecting a point of time at which the stack support 37A has reached a predetermined most elevated position is mounted to the rack 41A which is in engagement with the pinion 47A to move the rotary shaft 36A upward and downward. An optical sensor 93A is disposed opposite to an elevated position of the plate 92A (see FIGS. 1 and 4).

Referring next to the drive system for said other pinion 47B which is driven by a drive force supplied to the other pinion driving input shaft 75B, the input shaft 75B is connected at one end to an intermediate shaft 83B parallel thereto through a pair of pulleys 80B, 81B and a belt 82B, said intermediate shaft 83B being connected through a clutch 84B to an output shaft 85B for driving the pinion 47B. The input shaft 75B is connected at the other end thereof to another intermediate shaft 87B through a clutch 86B, said intermediate shaft 87B being acceleratedly connected to the output shaft 85B for driving the pinion 47B through a pair of different size gears 88B, 89B. It is noted that said clutches 84B and 86B are so designed that they are not brought in simultaneous engagement. Shown by 90B is a brake for the output shaft 85B for driving the pinion 47B. Said output shaft 85B is connected to the shaft 49B of the pinion 47B through an interlocking system 91B.

Figure 5:
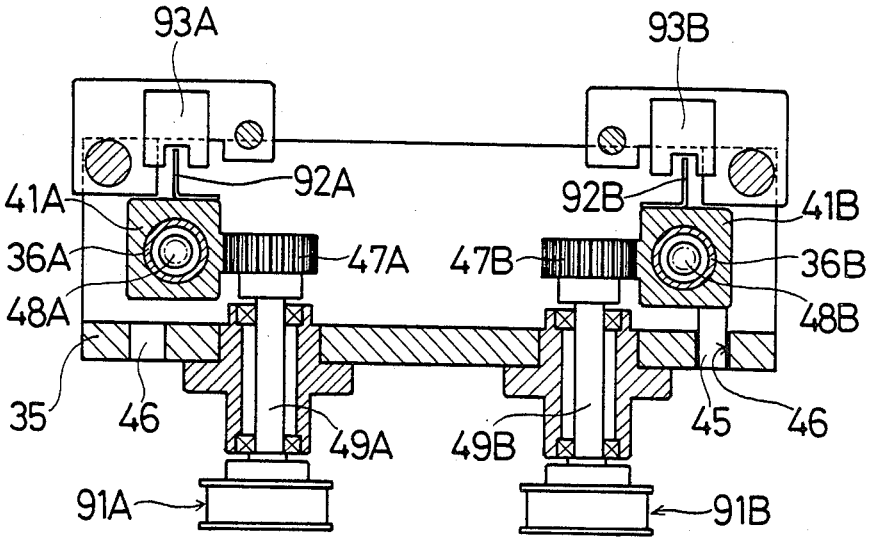
FIG. 5 is a section taken along line V—V in FIG. 4.

A plate 92B for detecting a point of time at which the stack support 37B has reached the most elevated position is mounted to the rack 41B which is in engagement with the pinion 47B to move the rotary shaft 36B upward and downward. An optical sensor 93B is disposed opposite to an elevated position of the plate 92B see FIGS. 1 and 5).

Rotation Drive Means for Stack supports

Nextly drive means for aforesaid crank 60, that is, rotation drive means for the rotary shafts 36A, 36B to which the stack supports 37A, 37B are respectively mounted, will be described with reference to FIGS. 1 and 6. A motor 100 for driving the crank 60 is connected to a transmission shaft 97 through a pair of pulleys 94, 95 and a belt 96, said transmission shaft 97 being connected through a clutch brake 98 to another shaft 99 so that it is momentarily movable toward and away from said shaft 99, being further connected to the shaft 58 of the crank 60 through a pair of pulleys 101, 102 and a belt 103. A disc 104 having a slit is fitted on said shaft 99, with an optical sensor 105 disposed opposite to the slitted disc 104.

Operation of Various Parts of Ham Loaf Slicing Machine

The movable stacker in the present embodiment of the invention is constructed as above described, and accordingly various relevant parts of the ham loaf slicing machine operate as follows:

Upward and Downward Movement of Stack Supports

As already mentioned, the parallel input shafts 75A, 75B for pinion drive are driven by the motor 10. Further, as already mentioned, clutches 84A and 86A, as well as clutches 84B and 86B, are so designed that they cannot be simultaneously brought in closed condition. Therefore, in the drive system for the one rack 41A, if the brack 90A is opened and the clutch 86A is closed (when the clutch 84A is in opened condition), the rotation of the input shaft 75A is transmitted to the output shaft 85A for pinion 47A driving through the intermediate shaft 87A and the pair of different size gears 88A, 89A, and the pinion 47A is rotated in a direction opposite to the direction of rotation of the input shaft 75A (i.e., in reverse direction), the rack 41A being thus moved upward.

Upward movement of the rack 41A means elevation of the stack support 37A. If it is so prearranged that when elevation of the rack 41A is detected by the optical sensor 93A, the clutch 86A is opened and the brake 90A is closed, the stack support 37A is caused to stop at its most elevated position.

It is noted in this connnection that the clutch 86A is closed simultaneously upon the clutch 84B being closed.

Whilst, the optical sensor 31 measures the number of rotations of the cutter 5. If it is so prearranged that when the optical sensor 31 detects a predetermined number of cutter rotations input to a control device not shown, namely, a predetermined number of ham loaf slices (N slices) per pack, a signal is sent to the brake 90A and the clutch 84A so that the clutch 84A is engaged simultaneously upon the brake 90A being released, then the pinion 47A is connected to the input shaft 75A through the pulleys 80A, 81A, the belt 82A, and the shaft 83A when the clutch 84A is engaged, and is thus rotated in same direction as that of rotation of the shaft 75A (i.e., in forward direction) so that the rack 41A is lowered. The downward movement of the rack 41A means downward movement of the stack support 37A.

The stack support 37A moves downward, and the optical sensor 31 again detects the prescribed number of rotations (N rotations), and simultaneously when the stack support 37A reaches its most lowered position, the clutch 84A is opened to stop the stack support 37A. Simultaneously, when the clutch 86A is closed, the stack support 37A begins to move upward because the brake 90A is in opened condition.

Meanwhile, in the drive system for the rack 41B, the rack 41B is elevated and lowered in same manner as above described under a drive force input to the input shaft 75B and accordingly the stack support 37B is elevated and lowered. That is, in the rack 41B drive system, the clutch 86B is closed simultaneously when the clutch 84A is closed so that the rack 41B is caused to begin upward movement. When the elevation of the rack 41B is detected by the optical sensor 93B, the clutch 86B is opened and the brake 90B is closed so that the rack 41B is caused to stop at its most elevated position. In this rack 41B drive system as well, simultaneously when the optical sensor detects the predetermined number of rotations N and when the stack support 37A reaches its most lowered position, the clutch 84B is closed and the brake 90B is released so that the rack 41B is caused to begin downward movement. The downward movement of the rack 41B means downward movement of the stack support 37B.

As is the case with the rack 41A drive system, the stuck support 37B moves downward, and the optical sensor 31 again detects the prescribed number of rotation, and simultaneously when the stack support 37B reaches its most lowered position, the clutch 84B is opened to stop the stack support 37B. Simultaneously, when the clutch 86B is closed the stack support 37B begins to move upward again.

In this way, the pair of drive systems for racks 41A, 41B actuate the pair of stack supports to move upward and downward so that the one stack support 37A or 37B is elevated while the other stack support 37B or 37A is in downward movement. The speed of upward movement of the stack supports 37A,37B and that of their downward movement are different from each other because each pair of the gears 88A, 89A and 88B, 89B are diametrically different while each pair of the pulleys 80A, 81A and 80B, 81B are diametricall same in size. That is, the speed of their upward movement is very fast, while the speed of their downward movement is slow. Therefore, during the time interval resulting from this speed difference, one or the other of the stack supports 37A, 37B is held on standby at its most elevated position at which it is stopped.

Rotational Movement of Stack Supports

When the clutch brake 98 between the shaft 97 constantly rotated by the motor 100 and the shaft 99 connected to the shaft 58 of the crank 60 is closed, the shaft 58 of the crank 60 is rotated. This clutch brake 98 is closed when one of the the stack supports 37A, 37B reaches its most lowered position and when the optical sensor 31 detects the predetermined number of rotations (N rotations) and further the optical sensor 105 detects that the shaft 99 has reached a predetermined rotational position, and it is opened when the optical sensor 105 detects that the shaft 99 has reached the predetermined rotational position again. The shaft 58 of the crank 60 is rotated 180° while the clutch brake 98 is closed.

The pair of stack supports 37A, 37B mounted one-side supportedly to the respective upper ends of the rotary shafts 36A, 36B are both fronted in same direction. When one of the stack supports 37A, 37B is brought to a position above the belt conveyor 32, the other stack support 37B or 37A is displaced from the position above the belt conveyor 32. Each time the shaft 58 of the crank 60 is rotated 180°, the timing belt 52 is alternately moved forward and backward a prescribed distance, whereby the stack supports are alternately rotated 180°. As earlier mentioned, the timing for this rotational movement is controlled by the optical sensors 31 and 105 and,therefore, such movement is actuated when the clutch 84A is closed and when the clutch 84B is closed. That is, the timing corresponds to a point of time when the predetermined number of ham loaf slices 6 (N slices) is stacked on one or the other of the stack supports 37A, 37B, whereby a stack 106 of slices is formed thereon, so that said one stack support 37A (or 37B) is going to start upward movement while the other stack support 37B (or 37A) is going to start downward movement.

Overall Movement of Movable Stacker

Movement of the pair of stack supports 37A,37B in 2N slicing cycles will now be described with reference to FIGS. 10*a*–10*e*.

Figure 10A:
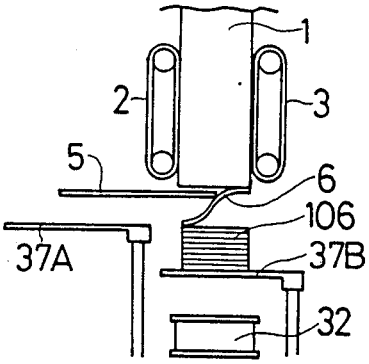
FIG. 10 is an explanatory view for the functions of the stackers.

(a) FIG. 10*a* shows one stack support 37A held on standby at its most elevated position while the other stack support 37B, at its N−1 lowered position, is going to have Nth loaf slice 6 placed on a stack 106 of N−1 slices. Immediately upon the Nth slice 6 being placed on the stack 106, the pair of stack supports 37A, 37B are simultaneously rotated 180°. Since slicing of ham loaf 1 is ceaselessly carried out according to a predetermined cycle, rotational movement of the stack supports 37A, 37B is effected from the moment when Nth loaf slice 6 is cut and before a next slice is cut.

Figure 10B:
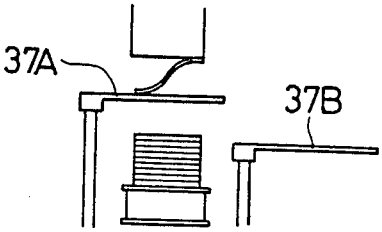

(b) As the stack support 37B is rotated outwardly from its position above the belt conveyor, the stack of slices 106 on the stack support 37B slips relatively on the stack support 37B under its inertia because the stack support 37B is rapidly rotated at a speed which exceeds a frictional force exerted between the upper surface of the stack support 37B and the underside of the stack, and accordingly the slices are allowed to drop onto the belt conveyor 32 as they are. The stack 106 of slices placed on the belt conveyor 32 is transported from the position below the slicing station 4 and to a location outside the ham loaf slicing machine. A next ham loaf slice 6, as it is cut, drops onto the stack support 37A rotated inwardly to the position above the belt conveyor 32. (FIG. 10*b*).

Figure 10C:
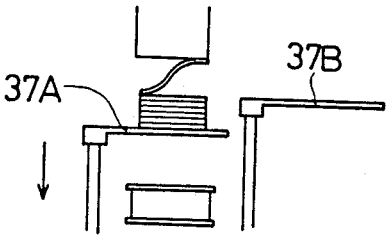

(c) Subsequently, in the course of the one stack support 37A being lowered while ham loaf slices being stacked thereon as they are cut, the other stack support 37B reaches its most elevated position . The other stack support 37B so elevated is held on standby at the most elevated position (FIG. 10*c*).

Thereafter, when the one stack support 37A has Nth loaf slice 6 placed on a stack of N−1 slices thereon at the N−1 lowered position and Nth slice 6 has been cut, the stack supports 37A, 37B are rotated 180° in a direction opposite from that in the case of item (a) above.

Figure 10D:
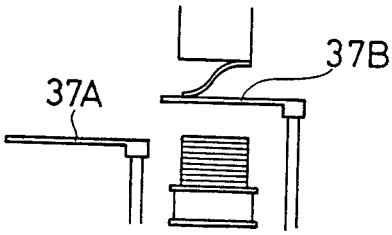

(d) As the stack supports 37A, 37B are rotated, the stack support 37A rotated outwardly from the position above the belt conveyor 32 discharges a stack of slices 106 onto the belt conveyor 32 from thereabove, and a first slice 6 of a next slicing cycle drops on the stack support 37B rotated inwardly to the position above the belt conveyor 32 (FIG. 10*d*).

Figure 10E:
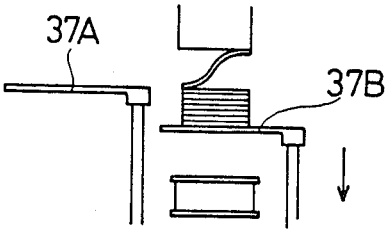

(e) Subsequently, in the course of the other stack support 37B being lowered, the one stack support 37A reaches the most elevated position (FIG. 10*e*).

Thus, the one stack support 37A is again held on standby at the most elevated position, and the other stack support 37B returns to the foregoing FIG. 10*a* condition in which it is going to have Nth slice placed on a stack 106 of N−1 slices thereon.

Stack Formation in Which Slices re Overlappingly Arranged

If the stack supports 37A, 37B are removed by removing bolts 64, 64 by which they are clamped to the respective upper ends of the rotary shafts 36A, 36B, ham loaf slices 6 are dropped directly onto the belt conveyor 32.

The slices 6 which have dropped on the belt conveyor 32 are arranged on the belt conveyor 32 at an overlap rate or intervals determined by the run speed of the belt conveyor 32.

Therefore, if the belt conveyor 32 is cyclically run at a low speed only during dropping cycles of N slices 6 and at a higher speed only for a period of time in which each next slice drops on the belt conveyor 32, groups of N slices 6 are stacked on the belt conveyor 32 in overlappling relation and in group to group spaced apart condition and are transported away from the ham loaf slicing machine accordingly (not shown).

ADVANTAGES OF THE INVENTION

According to the movable stacker of the invention, a pair of stack supports disposed at both sides of conveyor means are alternately moved upward and downward, and while one of the stack supports is in its downward movement, the other stack support which is presently not working is brought to a standby position at a predetermined most elevated level at a speed greater than the one stack support which is now working. Thus, immediately the one stack support in the slice receiving position completes a cycle of forming a stack of N slices thereon, this stack support in its most lowered position and the other stack support held on standby position outside the most elevated slice receiving position are simultaneously rotated at high speed so that the other stack support alternate the one stack support at the slice receiving position during a cycle of one slicing. Therefore, it is possible to maintain a constant thickness of slices by continuously operating the cutter of the food loaf slicing machine.

According to the movable stacker of the invention, one stack support on which a stack of N slices has been formed and which has reached its most lowered position can be momentarily displaced from the slice receiving position by rotating it at high speed, and simultaneously the stack of slices present on the stack support is caused to slip relatively thereon by taking advantage of the inertia of the stack so that the stack is allowed to drop as such onto the conveyor down below. Therefore, even if the rotation speed of the cutter is increased in order to obtain improved operating efficiency of the slicing machine, the stack of N slices on the stack support can be dropped in good timing, and at same time the other stack support can be displaced in good timely manner to the first slice receiving position by driving it simultaneously with the one stack support during a cycle of one slicing.

Further, according to the apparatus of the invention, alternation of stack supports at the slice receiving position and discharge of a stack of slices present on one of the stack supports can be simultaneously carried out simply by simultaneously rotating the stack supports at the predetermined elevated and lowered positions. Therefore, by interlockingly connecting the elevation and rotation drive means for the stack supports to the drive motor for the cutter for cutting food loaf slices it is possible to automatically adjust the respective run speeds of these drive systems to the run speed of the motor, so that the discharge of the stack on one or the other of the stack supports and the alternation of stack supports at the slice receiving position can be controlled at high accuracy and so that stacks of slices controlled to high accuracy standard can be cyclically obtained at high efficiency.

According to the movable stacker of the invention, each stack support is removably mounted to one or the other of the rotary shafts, and therefore by removing the pair of stack supports it is possible to obtain groups of N slices cyclically arranged on the belt conveyor in overlapping or spaced apart relation.

What is claimed is:

1. In a food loaf slicing machine including a slicing station into which a food loaf is advanced generally downwardly and in which slices of generally uniform thickness are cyclically sliced from the lower end of the loaf, the slices being allowed to drop down as they are cut, conveyor means disposed below the slicing station and in spaced apart relation therewith for receiving the slices thereon and transporting them outward from the position at which they are received, and a stacker having stack supports disposed between the slicing station and the conveyor means for receiving the slices on its stack supports at a position right under the slicing station, as they are dropped from above, so as to form stacks of N slices thereon and for discharging each stack, as it is formed, onto the conveyor means at a position substantially right below the stacker, said stacker comprising:

1. a pair of rotary shafts disposed at both sides of said conveyor means, one on each side, said rotary shafts being rotatable and up and down movable and having, at their respective upper ends, stack supports mouned thereon, one on each shaft;
2. each of said stack supports being movable along a predetermined closed-loop path downwardly from an intial slice receiving position right below the slicing station at which the stack support receives a first food loaf slice as the slice drops substantially freely from the slicing station, through a range of N−1 additional slice receiving positions each displaced approximately one additional slice thickness downwardly from said initial slice receiving position, rotatably outwardly from the final one of the additional slice receiving positions, then upwardly to same level as the initial slice receiving position, and rotatably to the initial slice receiving position;
3. stack support drive means connected to said pair of rotary shafts for moving said pair of stack supports along the closed-loop path in 2N slicing cycles, said drive means comprising elevation drive means for elevating one of the stack supports from the level of the final slice receiving position and to the level of the initial slice receiving position, while the other stack support is in downward movement from the initial slice receiving position and to the final slice receiving position, outside said slice receiving positions and at a velocity faster than the velocity of downward movement of said other stack support, and rotation drive means for rotating one of the stack supports outwardly of the final slice receiving position after said one stack support has reached said final slice receiving position and, simultaneously therewith, rotating the other stack support at its most elevated position and toward the initial slice receiving position; and
4. the upper surface of said stack supports each having a coefficient of friction to the cut surface of each food loaf slice which is smaller than that between the cut surfaces of food loaf slices so as to enable a stack of slices on the stack support to relatively slip on the stack support at the most lowered position thereof, when the stack support is rotated, so that the stack of slices is freely dropped generally downwardly, said stack support rotation drive means being able to rapidly rotate the stack support momentarily by a force which exceeds the frictional force exerted between the underside of the stack of slices on the stack support and the upper surface of the stack support.

2. A movable stacker for a food loaf slicing machine as set forth in claim 1, wherein said stack supports each consists of a plate member having a plurality of lightening holes bored on the surface thereof.

3. A movable stacker for a food loaf slicing machine as set forth in claim 1, wherein said stack supports each is removably mounted on the corresponding one of said rotary shafts.

4. A movable stacker for a food loaf slicing machine as set forth in claim 1, wherein said stack supports each has its upper surface slightly backwardly sloped down in the direction of its rotation when the stack support rotates outwardly of its slice receiving position above said conveyor means.

5. A movable stacker for a food loaf slicing machine as set forth in claim 1, wherein said pair of rotary shafts, each having a stack support mounted thereon at its upper end, are each in the form of a hollow shaft splinedly fitted on one or the other of a pair of parallel spline shafts, said pair of rotary shafts being connected to said rotation drive means through said pair of spline shafts, and wherein a pair of racks, each parallel to one or the other of said rotary shafts, are each fitted on a correresponding one of said rotary shafts rotatably relative thereto but relatively unslidably, said racks being upward and downward movable in relation to the frame of the machine but unrotatably locked, said pair of rotary shafts being connected to said elevation drive means through said pair of racks.

* * * * *